US008896428B2

(12) United States Patent
Shalala

(10) Patent No.: US 8,896,428 B2
(45) Date of Patent: Nov. 25, 2014

(54) MEDICINE DISPENSING RECORD SYSTEM

(71) Applicant: Daniel A. Shalala, Las Vegas, NV (US)

(72) Inventor: Daniel A. Shalala, Las Vegas, NV (US)

( * ) Notice: Subject to any disclaimer, the term of this patent is extended or adjusted under 35 U.S.C. 154(b) by 37 days.

(21) Appl. No.: 13/676,074

(22) Filed: Nov. 13, 2012

(65) Prior Publication Data

US 2014/0130453 A1 May 15, 2014

(51) Int. Cl.

| | |
|---|---|
| ***G08B 1/00*** | (2006.01) |
| ***G04G 9/00*** | (2006.01) |
| ***B65B 7/28*** | (2006.01) |

(52) U.S. Cl.

CPC ... *G04G 9/00* (2013.01); *B65B 7/28* (2013.01)

USPC ..... 340/309.16

(58) Field of Classification Search

USPC ..... 340/309.16, 573.1, 691.6, 815.4, 340/384.71, 393.4; 368/10, 110, 112

See application file for complete search history.

(56) References Cited

U.S. PATENT DOCUMENTS

| | | | | |
|---|---|---|---|---|
| 5,313,439 | A * | 5/1994 | Albeck | 368/10 |
| 6,324,123 | B1 * | 11/2001 | Durso | 368/10 |
| 6,633,796 | B1 * | 10/2003 | Pool et al. | 700/231 |
| 7,907,477 | B2 * | 3/2011 | Puzia | 368/10 |
| 8,534,220 | B1 * | 9/2013 | Olson | 116/309 |
| 2006/0124501 | A1 * | 6/2006 | McNeely | 206/534 |
| 2008/0165623 | A1 * | 7/2008 | Morse | 368/10 |
| 2011/0069587 | A1 * | 3/2011 | Brandon | 368/10 |
| 2011/0190928 | A1 * | 8/2011 | Jeyarajan | 700/232 |

* cited by examiner

*Primary Examiner* — Phung Nguyen

(74) *Attorney, Agent, or Firm* — Ariel S. Bentolila; Bay Area IP Group LLC

(57) ABSTRACT

A dosage cap records and displays dosage information about a medicine, including, the projected time that the next dosage of medicine is needed, the time interval between numerous administrations of the medicine, the time and/or date that the last dose was administered, the current daily intake amount, the date the dose was administered, or scheduled administration of the medicine. The time and date of the last dosage of medicine administered can be reset and updated when a subsequent dose of medicine is administered. The cap secures over a medicine container lid to provide easy visibility of the dosage information to a user. A shaft extends downwardly from the cap to secure the cap to the medicine container lid by penetrating the lid with a sharp point. A fastener attaches to the end of the shaft for securing the cap to the medicine bottle lid.

19 Claims, 8 Drawing Sheets

MEDICINE DISPENSING RECORD SYSTEM

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

One or more embodiments of the invention generally relate to medicine dispensing. More particularly, one or more embodiments of the invention relate to a medicine dispensing record system.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

The following is an example of a specific aspect in the prior art that, while expected to be helpful to further educate the reader as to additional aspects of the prior art, is not to be construed as limiting the present invention, or any embodiments thereof, to anything stated or implied therein or inferred thereupon. By way of educational background, another aspect of the prior art generally useful to be aware of is that medicine may include a special food or a chemical that makes someone better when they are ill. A lot of medicines are liquid and can be bought in a small bottle. Other medicines may come in pills or capsules. The doctor may tell the patient or caregiver how much medicine to take each day. Most medicines cannot be bought unless a medical professional has prescribed the medicine for the patient. Often, the doctor or pharmacist provide specific instructions for administering the medicine, including dosages, quantities, and warnings.

Typically, medicine containers are containers that contain medicine prescribed by doctors. Medicine containers come in different shapes, sizes, and colors. The most common is an orange pill bottle, or opaque liquid bottle.

Typically, dosage forms are a mixture of active drug components and nondrug components. Depending on the method of administration they come in several types. These are liquid dosage form, solid dosage form and semisolid dosage forms. Various dosage forms may exist for a single particular drug, since different medical conditions can warrant different routes of administration. Additionally, a specific dosage form may be a requirement for certain kinds of drugs, as there may be issues with various factors like chemical stability or pharmacokinetics. The oral and intravenous doses of a medicine may also vary depending on the patient, the strength of the medication, and the severity of the illness.

In view of the foregoing, it is clear that these traditional techniques are not perfect and leave room for more optimal approaches.

BRIEF DESCRIPTION OF THE DRAWINGS

The present invention is illustrated by way of example, and not by way of limitation, in the figures of the accompanying drawings and in which like reference numerals refer to similar elements and in which.

Figure 1:
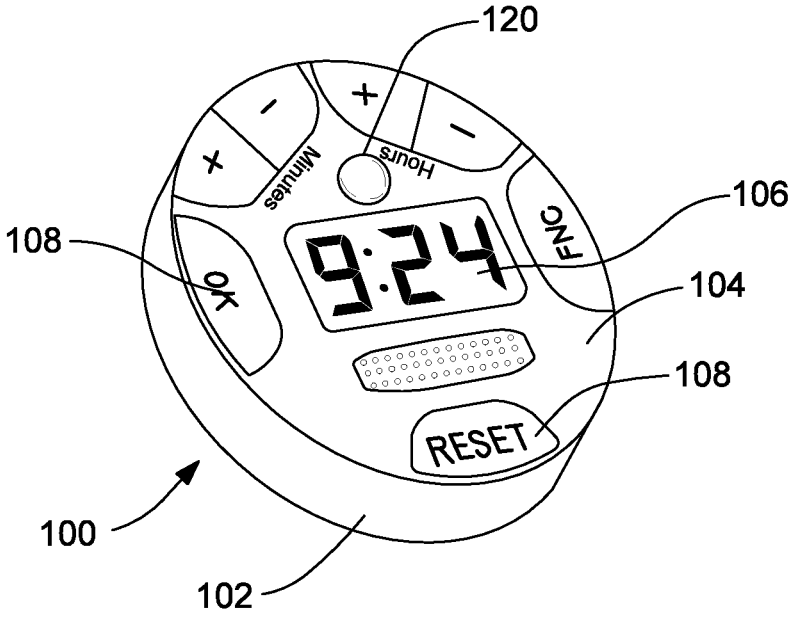
FIG. 1 illustrates a detailed perspective view of an exemplary medicine dispensing record system, in accordance with an embodiment of the present invention.

Unless otherwise indicated illustrations in the figures are not necessarily drawn to scale.

DETAILED DESCRIPTION OF SOME EMBODIMENTS

Embodiments of the present invention are best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

It is to be further understood that the present invention is not limited to the particular methodology, compounds, materials, manufacturing techniques, uses, and applications, described herein, as these may vary. It is also to be understood that the terminology used herein is used for the purpose of describing particular embodiments only, and is not intended to limit the scope of the present invention. It must be noted that as used herein and in the appended claims, the singular forms "a," "an," and "the" include the plural reference unless the context clearly dictates otherwise. Thus, for example, a reference to "an element" is a reference to one or more elements and includes equivalents thereof known to those skilled in the art. Similarly, for another example, a reference to "a step" or "a means" is a reference to one or more steps or means and may include sub-steps and subservient means. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

Unless defined otherwise, all technical and scientific terms used herein have the same meanings as commonly understood by one of ordinary skill in the art to which this invention belongs. Preferred methods, techniques, devices, and materials are described, although any methods, techniques, devices, or materials similar or equivalent to those described herein may be used in the practice or testing of the present invention. Structures described herein are to be understood also to refer to functional equivalents of such structures. The present invention will now be described in detail with reference to embodiments thereof as illustrated in the accompanying drawings.

From reading the present disclosure, other variations and modifications will be apparent to persons skilled in the art. Such variations and modifications may involve equivalent and other features which are already known in the art, and which may be used instead of or in addition to features already described herein.

Although Claims have been formulated in this Application to particular combinations of features, it should be understood that the scope of the disclosure of the present invention also includes any novel feature or any novel combination of features disclosed herein either explicitly or implicitly or any generalization thereof, whether or not it relates to the same invention as presently claimed in any Claim and whether or not it mitigates any or all of the same technical problems as does the present invention.

Features which are described in the context of separate embodiments may also be provided in combination in a single embodiment. Conversely, various features which are, for brevity, described in the context of a single embodiment, may also be provided separately or in any suitable subcombination. The Applicants hereby give notice that new Claims may be formulated to such features and/or combinations of such features during the prosecution of the present Application or of any further Application derived therefrom.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

As is well known to those skilled in the art many careful considerations and compromises typically must be made when designing for the optimal manufacture of a commercial implementation any system, and in particular, the embodiments of the present invention. A commercial implementation in accordance with the spirit and teachings of the present invention may configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art, using their average skills and known techniques, to achieve the desired implementation that addresses the needs of the particular application.

In the following description and claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

A "computer" may refer to one or more apparatus and/or one or more systems that are capable of accepting a structured input, processing the structured input according to prescribed rules, and producing results of the processing as output. Examples of a computer may include: a computer; a stationary and/or portable computer; a computer having a single processor, multiple processors, or multi-core processors, which may operate in parallel and/or not in parallel; a general purpose computer; a supercomputer; a mainframe; a super mini-computer; a mini-computer; a workstation; a micro-computer; a server; a client; an interactive television; a web appliance; a telecommunications device with internet access; a hybrid combination of a computer and an interactive television; a portable computer; a tablet personal computer (PC); a personal digital assistant (PDA); a portable telephone; application-specific hardware to emulate a computer and/or software, such as, for example, a digital signal processor (DSP), a field-programmable gate array (FPGA), an application specific integrated circuit (ASIC), an application specific instruction-set processor (ASIP), a chip, chips, a system on a chip, or a chip set; a data acquisition device; an optical computer; a quantum computer; a biological computer; and generally, an apparatus that may accept data, process data according to one or more stored software programs, generate results, and typically include input, output, storage, arithmetic, logic, and control units.

"Software" may refer to prescribed rules to operate a computer. Examples of software may include: code segments in one or more computer-readable languages; graphical and or/textual instructions; applets; pre-compiled code; interpreted code; compiled code; and computer programs.

A "computer-readable medium" may refer to any storage device used for storing data accessible by a computer. Examples of a computer-readable medium may include: a magnetic hard disk; a floppy disk; an optical disk, such as a CD-ROM and a DVD; a magnetic tape; a flash memory; a memory chip; and/or other types of media that can store machine-readable instructions thereon.

A "computer system" may refer to a system having one or more computers, where each computer may include a computer-readable medium embodying software to operate the computer or one or more of its components. Examples of a computer system may include: a distributed computer system for processing information via computer systems linked by a network; two or more computer systems connected together via a network for transmitting and/or receiving information between the computer systems; a computer system including two or more processors within a single computer; and one or more apparatuses and/or one or more systems that may accept data, may process data in accordance with one or more stored software programs, may generate results, and typically may include input, output, storage, arithmetic, logic, and control units.

A "network" may refer to a number of computers and associated devices that may be connected by communication facilities. A network may involve permanent connections such as cables or temporary connections such as those made through telephone or other communication links. A network may further include hard-wired connections (e.g., coaxial cable, twisted pair, optical fiber, waveguides, etc.) and/or wireless connections (e.g., radio frequency waveforms, free-space optical waveforms, acoustic waveforms, etc.). Examples of a network may include: an internet, such as the Internet; an intranet; a local area network (LAN); a wide area network (WAN); and a combination of networks, such as an internet and an intranet.

Exemplary networks may operate with any of a number of protocols, such as Internet protocol (IP), asynchronous transfer mode (ATM), and/or synchronous optical network (SONET), user datagram protocol (UDP), IEEE 802.x, etc.

Embodiments of the present invention may include apparatuses for performing the operations disclosed herein. An apparatus may be specially constructed for the desired purposes, or it may comprise a general-purpose device selectively activated or reconfigured by a program stored in the device.

Embodiments of the invention may also be implemented in one or a combination of hardware, firmware, and software. They may be implemented as instructions stored on a machine-readable medium, which may be read and executed by a computing platform to perform the operations described herein.

In the following description and claims, the terms "computer program medium" and "computer readable medium" may be used to generally refer to media such as, but not limited to, removable storage drives, a hard disk installed in hard disk drive, and the like. These computer program products may provide software to a computer system. Embodiments of the invention may be directed to such computer program products.

An algorithm is here, and generally, considered to be a self-consistent sequence of acts or operations leading to a desired result. These include physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers or the like. It should be understood, however, that all of these and similar terms are to be associated with the appropriate physical quantities and are merely convenient labels applied to these quantities.

Unless specifically stated otherwise, and as may be apparent from the following description and claims, it should be appreciated that throughout the specification descriptions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices.

In a similar manner, the term "processor" may refer to any device or portion of a device that processes electronic data from registers and/or memory to transform that electronic data into other electronic data that may be stored in registers and/or memory. A "computing platform" may comprise one or more processors.

A non-transitory computer readable medium includes, but is not limited to, a hard drive, compact disc, flash memory, volatile memory, random access memory, magnetic memory, optical memory, semiconductor based memory, phase change memory, optical memory, periodically refreshed memory, and the like; however, the non-transitory computer readable medium does not include a pure transitory signal per se.

The present invention will now be described in detail with reference to embodiments thereof as illustrated in the accompanying drawings.

There are various types of medicine dispensing record systems 100 that may be provided by preferred embodiments of the present invention. In some embodiments, the medicine dispensing record system 100 may include a cap record portion 102 that either permanently or detachably positions on top of a medicine container cap 202 for recording and displaying dosage information about a medicine, including, without limitation, the projected time that the next dosage of medicine is needed, the time interval between numerous administrations of the medicine, the time and/or date that the last dose was administered, the current daily intake amount, the amount of medicine administered, the date the dose was administered, contents of a medicine container, scheduled administration of the medicine, and warnings about the medicine. The time and date of the last dosage of medicine administered may be reset and updated when a subsequent dose of medicine is administered by manipulating at least one control portion, such as, without limitations, buttons, scroll wheels, and switches. However, in other embodiments, a processor may function to automatically update a timer every time a dosage of the medicine is administered. The cap record portion may also assist a user to administer the medicine properly through numerous display and alert functions, including, without limitation, an audio portion and an illumination portion 120. In some embodiments, a power source 118 positioned inside the cap record portion may provide the power for the electrical components. Those skilled in the art, in light of the present teachings, will recognize that the dosage information displayed on the cap record portion may allow a user to continue taking the medication safely and appropriately. In one alternative embodiment, the dosage information may include the same reference point used by hospitals for the user when following the regimen set forth by a medical professional.

In some embodiments, the medicine container cap 202 may secure over at least one opening in a medicine container 200 to inhibit the entering and exiting of the medicine. The cap record portion may secure over the medicine container cap to provide easy visibility of the dosage information to a user. The cap record portion may include a record surface 104 for presenting the external, visible surface where the dosage information is viewed and controlled. The record surface may include at least one display portion 106 for viewing the dosage information. The display portion may include, without limitation, an LED digital screen, and a rotatable wheel with interspaced slots that overlays a calendar to rotatably display times and/or dates. The record surface may further include at least one control portion 108 for controlling a timer. The control portion may include, without limitation, at least one button for setting the timer at least one button for resetting the timer, at least one button for manipulating dosage information. The timer may indicate the relative time intervals between dosages of the medicine, such as, without limitation, the projected time that the next dosage of medicine is needed, the time interval between numerous administrations of the medicine, the time and/or date that the last dose was administered, and projected time for the next dosage of medicine. Those skilled in the art will recognize that each control portion may accidently be effected by engaging in contact with an object. For example, without limitation a button depresses, causing the timer to reset and the dosage information to spoil. The present invention may include a control portion cover 122 for protecting the at least one control portion from physical contact. However, in one embodiment, the control portion cover may provide access to at least one control portion positioned on the sidewall of the cap record portion. A slot 124 may allow the user to manipulate each control portion that is accessible from the slot. In one embodiment, a mounting surface 110 may engage the medicine container cap. A shaft 112 may extend from the mounting surface. The shaft may serve to secure the cap record portion to the medicine container cap by penetrating the medicine container cap with a sharp point on a distal end 114 of the shaft. However, in other embodiments, the medicine container cap may include an aperture to receive the shaft, with the shaft rotatably fastening inside the medicine container cap. Those skilled in the art will recognize that, while the shaft's penetration of the medicine container cap may create sufficient grip for pressing the cap record portion against the medicine container cap, a fastener 116 that joins with the distal end of the shaft would provide an additional component for securing the cap record portion. The fastener may include a pliant rubber material efficacious for snugly receiving a sharp distal end of the shaft. The fastener may further include at least one projecting tab for facilitating the manipulation and gripping of the fastener. In some embodiments, the fastener may include internal threads for rotatably fastening onto a threaded distal end.

FIG. 1 illustrates a detailed perspective view of an exemplary medicine dispensing record system, in accordance with an embodiment of the present invention. In some embodiments, the medicine dispensing record system may include a cap record portion that either permanently or detachably positions on top of a medicine container cap for recording and displaying dosage information about a medicine, including, without limitation, the projected time that the next dosage of medicine is needed, the time interval between numerous administrations of the medicine, the time and/or date that the last dose was administered, the current daily intake amount, the amount of medicine administered, the date the dose was administered, contents of a medicine container, scheduled administration of the medicine, and warnings about the medicine. The time and date of the last dosage of medicine administered may be reset and updated when a subsequent dose of medicine is administered by manipulating at last one control portion. The at least one control portion may include, without limitation, buttons, scroll wheels, and switches. However, in other embodiments, a processor may function to automatically update a timer every time a dosage of the medicine is administered.

For example, without limitation, an hour button and a minute button may be depressed until the digital display screen displays the appropriate time. An OK button may be depressed to indicate approval. At the desired time, the audio portion may beep, and the illuminating portion may flash to indicate the time for taking the medicine dosage. In yet another example, a multiplicity of times, each representing different types of medicine may be programmed into the cap record portion, whereby a different audio signal emits to indicate a correlating medicine. In yet another example, without limitation, the Function button may be depressed one time to activate an LCD screen that flashes an initial time of 00:00 on the display portion. The hour and minute buttons may be manipulated to set the time, and then the OK button may be depressed. Next, the Function button may be depressed once to select a 24 hour dosage interval, and then the OK is depressed. In this manner, the user may be alerted for the need to administer the medicine in 24 hours. In another embodiment, the Function button may be depressed twice to select a 12 hour dosage interval and then the OK button. In another embodiment, the Function button may be depressed three times to select an 8 hour dosage interval, and then the OK button. In another embodiment, the Function button may be depressed four times to select a 6 hour interval, and then the OK button. In another embodiment, the Function button may be pressed five times to use the hour and minute buttons to program in a specific dosage interval, and then the OK button. In one embodiment, the alarm indicates the required time to administer the medicine. The alarm may be terminated, and the cap record portion may be prepared for the next activation by depressing a button on the sidewall of the cap record portion. However, if the user administers the medicine prior to the prescribed time, the OK button may be depressed to silence the alarm and cap record portion is prepared for the next activation. However, if the user administers the medicine after the prescribed time, but still requires the next dosage time to remain on its regular schedule, the button on the sidewall may be depressed. However, if the user administers the medicine later than the prescribed time, such as 15 minutes later, and the user requires rescheduling the next dosage time to be 15 minutes later than originally scheduled, the user may depress the Reset button. In any case, when the medicine container is empty, the user may remove the cap record portion from the medicine container cap and reuse it for a subsequent medicine container.

Those skilled in the art, in light of the present teachings, will recognize that The versatility of the medicine dispensing record system may address two primary dosage situations: medications that require dosage times that remain constant even if the last dosage time was delayed or missed; and medications that require adjustment to dosage times if pre-set dosage times are delayed or missed. Examples of these occurrences are described below using a thrice daily interval setting.

For medications requiring the same dosage time: For thrice daily intervals the alarm sounds every 8 hours. If the alarm is set for noon, it sounds at noon and then again at exactly 8 pm and even if the Noon alarm was not turned off until 12:15 pm. This function is achieved by depressing the button on the sidewall of the cap record portion.

For medications that require adjustment to dosage times if pre-set dosage times are delayed or missed: For thrice daily intervals the alarm sounds every 8 hours. If the alarm is set for Noon, it sounds at Noon and then again at exactly 8 pm. If the meds are taken on time the sidewall button is pressed. However if the patient is delayed in taking the medication, and the next dose must be consumed exactly 8 hours after the previous dose than the user pushes the Reset button to ensure the alarm sounds 8 hours after the last dosage consumption.

In some embodiments, the cap record portion may secure over the medicine container cap to provide easy visibility of the dosage information to a user. The cap record portion may include a record surface for presenting the external, visible surface where the dosage information is viewed and controlled. The record surface may include at least one display portion for viewing the dosage information. The display portion may include, without limitation, an LED digital screen, and a rotatable wheel with interspaced slots that overlays a calendar to rotatably display times and/or dates. The record surface may further include at least one control portion for controlling a timer. The control portion may include, without limitation, and at least one button for setting the timer, at least one button for resetting the timer, at least button for manipulating dosage information. The timer may indicate the relative time intervals between dosages of the medicine, such as, without limitation, the projected time that the next dosage of medicine is needed, the time interval between numerous administrations of the medicine, the time and/or date that the last dose was administered, and projected time for the next dosage of medicine. Suitable materials for fabricating the cap record portion may include, without limitation, polystyrene, polyvinyl chloride, high density polyethylene, plastic, metal, polyurethane, silicone, and an antimicrobial material. In one embodiment, the cap record portion may include a disk shape having a diameter of 1½" and a depth of ½", capable of positioning onto a standard tubular shaped pill bottle. However, other sizes and dimensions of the cap record portion may be utilized to conform to various types and sizes of medicine container.

In one embodiment, the record surface may include at least one display portion and at least one control portion for controlling and displaying the dosage information. For example, without limitation, the display portion may include a LCD screen having display capabilities of four digits separated by a colon. Directly above the LCD screen are four control buttons that allow for time and specific dosage settings. The control buttons on the left are labeled Minutes and those on the right are labeled Hours. To the right of these time-setting buttons is a button marked Function, and which is used to select the operational format of the digital timing mechanism by a series of depressions. To the left of these time-setting buttons is a button marked OK, and which is used to finalize the selected operation format of the digital timing mechanism after use of the Function button. Directly above the LCD screen is a projecting lighting capsule. Directly below the LCD screen is a perforated area for accommodation of the audio portion in the form of an audio speaker broadcast. Directly below the audio speaker broadcast is a control button for resetting dosage times upon the digital timing mechanism. All operational buttons upon the top-surface of the base casing are contained within extending sidewalls on the perimeter of the cap record portion. From the sidewall of the cap record portion is a button connected by wiring to the audio speaker, for control of its function. Upon the bottom surface of the base casing is a compartment for a power source, such as a disc battery, which may be accessible by a power source cover. However, in other embodiments, different variations and combinations of the at least one display portion and at least one control portion may be utilized.

Figure 2:
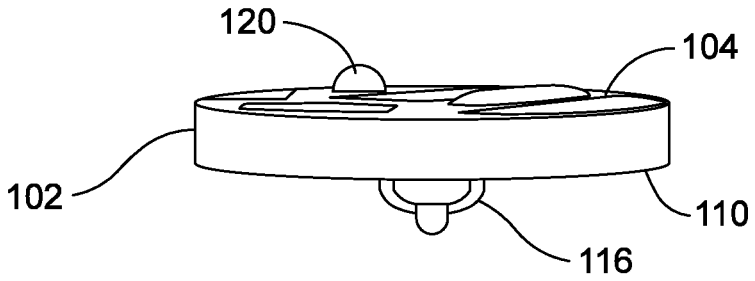
FIG. 2 illustrates an elevated side view of an exemplary cap record portion, in accordance with an embodiment of the present invention.

FIG. 2 illustrates an elevated side view of an exemplary cap record portion, in accordance with an embodiment of the present invention. In some embodiments, the cap record portion may include a fastener that joins with the cap record portion. The fastener may be efficacious for securely joining the cap record portion with the medicine container cap. The fastener may include a rubber material efficacious for snugly receiving a sharp distal end of the shaft. The fastener may further include at least one projecting tab for facilitating the manipulation and gripping of the fastener. For example, without limitation, the user may twist the fastener by grasping a pair of projecting tabs from opposite sides of the fastener. In some embodiments, the fastener may include internal threads for rotatably fastening onto a threaded distal end.

Figure 3A:
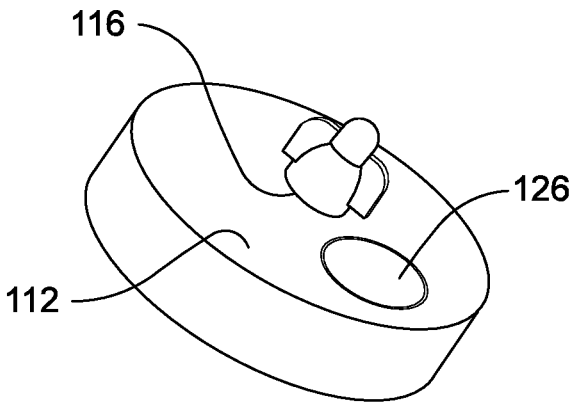
FIGS. 3A and 3B illustrate a detailed perspective view of an exemplary cap record portion positioned in conjunction with an exemplary fastener, in accordance with an embodiment of the present invention, with FIG. 3A illustrating an exemplary fastener attached to an exemplary distal end, and FIG. 3B illustrating an exemplary fastener detached from an exemplary distal end.
Figure 3B:
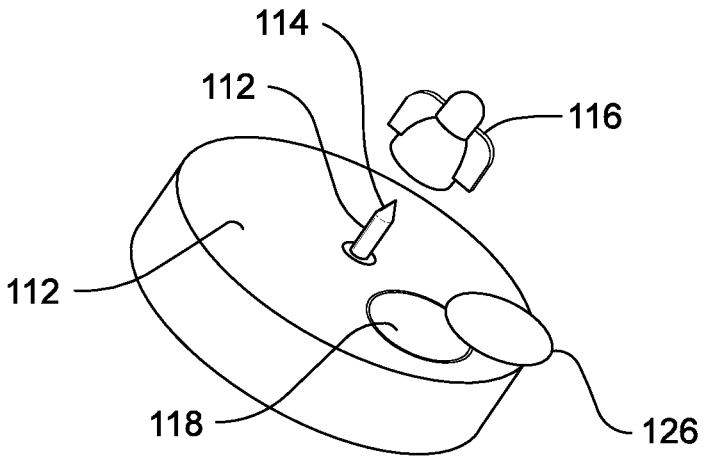

FIGS. 3A and 3B illustrate a detailed perspective view of an exemplary cap record portion positioned in conjunction with an exemplary fastener, in accordance with an embodiment of the present invention, with FIG. 3A illustrating an exemplary fastener attached to an exemplary distal end, and FIG. 3B illustrating an exemplary fastener detached from an exemplary distal end. In some embodiments, the medicine dispensing record system may include a power source positioned inside the cap record portion for providing power for the electrical components. The power source may be utilized to power the electrical components in the cap record portion, including, without limitation, the processor, the illuminating portion, the audio portion, and the display portion. A power source cover may cover the power source to protect from the elements. In some embodiments, the power source cover may hingedly rotate over the power source.

Figure 4:
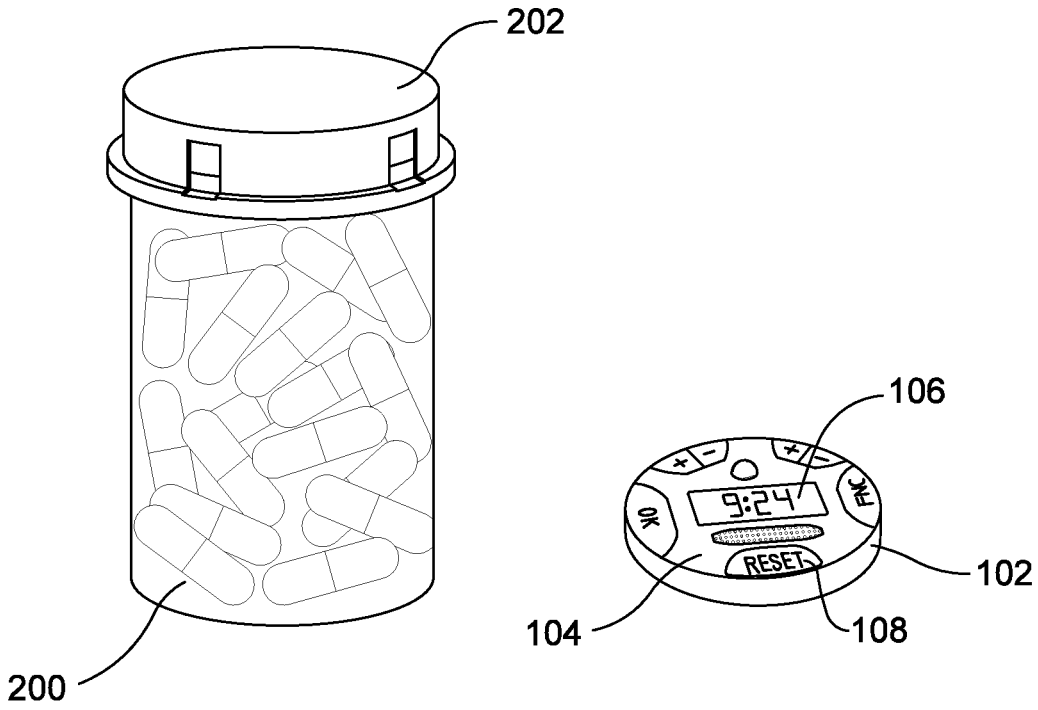
FIG. 4 illustrates a detailed perspective view of an exemplary medicine container with an exemplary medicine container cap positioned over the opening, and a cap record portion positioned in proximity, in accordance with an embodiment of the present invention.

FIG. 4 illustrates a detailed perspective view of an exemplary medicine container with an exemplary medicine container cap positioned over the opening, and a cap record portion positioned in proximity, in accordance with an embodiment of the present invention. In some embodiments, the medicine container cap may secure over at least one opening in a medicine container to inhibit the entering and exiting of the medicine. Those skilled in the art, in light of the present teachings, will recognize that the medicine container cap may be dimensioned and sized to attach to a variety of medicine containers, including, without limitation, a tubular pill bottle, a liquid medicine bottle, a rectangular pill box, a cylinder shaped bottle, and a pill dispenser. In some embodiments, the medicine container cap may be permanently glued or a part of the mold of the medicine container. However, in other embodiments, the medicine container cap may snap or slide onto the medicine container. The medicine container cap may secure to the medicine container through a perimeter lip. In some embodiments, the perimeter lip may be annular and threaded, designed to rotatably engage the outer sidewall of the at least one opening in the medicine container. In some embodiments, the perimeter lip may be permanently glued or a part of the mold of the container capping member. However, in other embodiments, the perimeter lip may snap or slide onto the aperture. Those skilled in the art, in light of the present teachings, will recognize that the perimeter lip may create a child-proof seal with the at least one opening for inhibiting access to the medicine by children, whereby the medicine container cap is pressed against the medicine container while simultaneously rotating the medicine container cap counter clockwise to remove the container capping member. In some embodiments, the cap record portion may be fabricated into a single unit with a medicine container cap. In another embodiment, the cap record portion may be fabricated into a single unit with a medicine container cap and a medicine container. In yet another embodiment, the cap record portion may be fabricated in variations for application upon sleeves that host multiple separate-yet-attached medication storage compartments. In yet another embodiment, the cap record portion may be mounted and secured to or near the medicine containers by numerous means, including, without limitation, a securing bracket, a clip, and a tethering device.

Figure 5A:
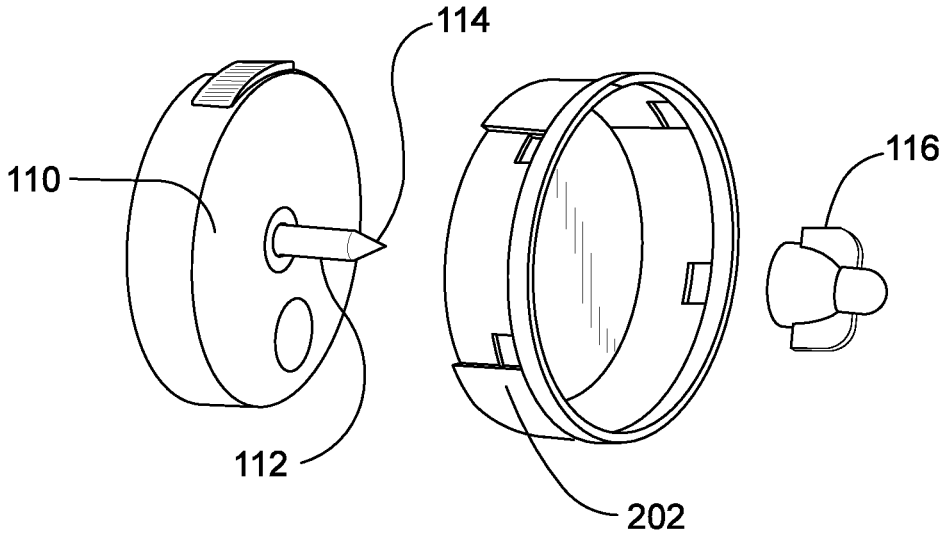
FIGS. 5A and 5B illustrate a detailed perspective view of an exemplary cap record portion, and exemplary medicine container cap, and an exemplary fastener positioned in conjunction with each other, with FIG. 5A illustrating an exemplary cap record portion, and exemplary medicine container cap, and an exemplary fastener separate, and FIG. 5B illustrating an exemplary cap record portion, and exemplary medicine container cap, and an exemplary fastener joined together, in accordance with an embodiment of the present invention.
Figure 5B:
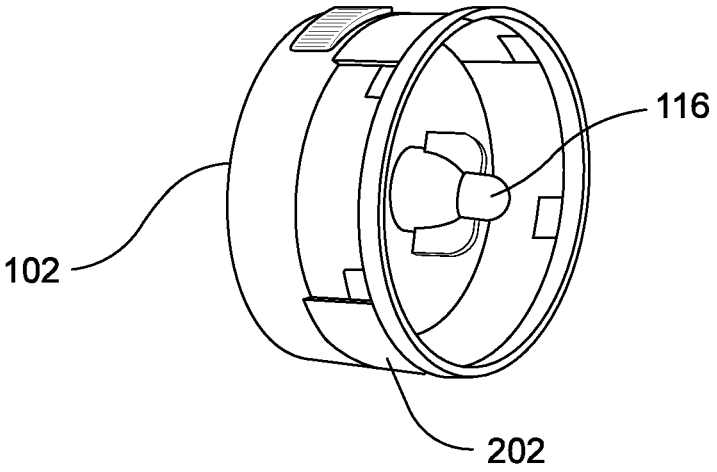

FIGS. 5A and 5B illustrate a detailed perspective view of an exemplary cap record portion, and exemplary medicine container cap, and an exemplary fastener positioned in conjunction with each other, with FIG. 5A illustrating an exemplary cap record portion, and exemplary medicine container cap, and an exemplary fastener separate, and FIG. 5B illustrating an exemplary cap record portion, and exemplary medicine container cap, and an exemplary fastener joined together, in accordance with an embodiment of the present invention. In some embodiments, a shaft may extend from the mounting surface. The shaft may serve to secure the cap record portion to the medicine container cap by penetrating the medicine container cap with a sharp point on a distal end of the shaft. However, in other embodiments, the medicine container cap may include an aperture to receive the shaft, with the shaft rotatably fastening inside the medicine container cap. In yet another embodiment, the shaft may not be utilized, and the cap record portion may secure to the medicine container cap with other means, including, without limitation, hook-and-loop, clips, adhesives, straps, and bolts. In one embodiment, the shaft may include a square, metal shaft that extends about 1" from the mounting surface. Suitable materials for the shaft may include, without limitation, stainless steel, aluminum, metal, and plastic. In yet another embodiment, the shaft may include a triangle or any shape with true angles. Those skilled in the art, in light of the present teachings, will recognize that the square shape of the shaft prevents the medicine container cap from spinning within the fastener, whereas a rounded shaft may spin within the fastener. This excessive spinning may cause the fastener to accidently detach, which consequently may result in the cap record portion separating from the medicine container cap. Whereas, the square shaft prevents the fastener from falling off, and therefore ensures the cap record portion remains secure.

Those skilled in the art will recognize that the shaft's penetration of the medicine container cap may create sufficient grip for pressing the cap record portion against the medicine container cap. However, a fastener that joins with the distal end of the shaft may provide an additional component for securing the cap record portion. The fastener may be efficacious for securely joining the cap record portion with the medicine container cap. The fastener may include a pliant rubber material efficacious for snugly receiving a sharp distal end of the shaft. The fastener may further include at least one projecting tab for facilitating the manipulation and gripping of the fastener. For example, without limitation, the user may twist the fastener by grasping a pair of projecting tabs from opposite sides of the fastener. In some embodiments, the fastener may include internal threads for rotatably fastening onto a threaded distal end.

Figure 6:
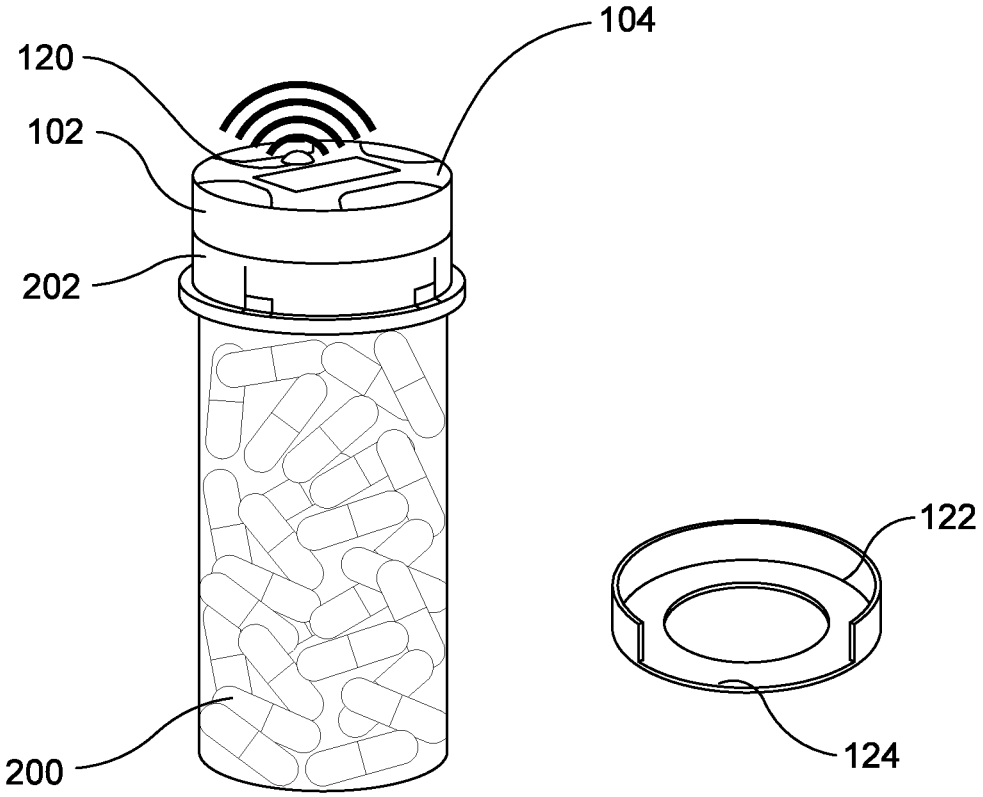
FIG. 6 illustrates a detailed perspective view of an exemplary medicine dispensing record system with an exemplary illuminating member alerting for medicine dosage positioned in proximity to an exemplary control portion cover, in accordance with an embodiment of the present invention.

FIG. 6 illustrates a detailed perspective view of an exemplary medicine dispensing record system with an exemplary illuminating member alerting for medicine dosage positioned in proximity to an exemplary control portion cover, in accordance with an embodiment of the present invention. In one embodiment, the illuminating portion may include a red LED bulb that flashes in a rhythmic pattern. Those skilled in the art will recognize that each control portion may accidently be effected by engaging in contact with an object. For example, without limitation a button depresses, causing the timer to reset and the dosage information to spoil. The present invention may include a control portion cover for protecting the at least one control portion from physical contact. However, in one embodiment, the control portion cover may provide access to at least one control portion positioned on the sidewall of the cap record portion. A slot may allow the user to manipulate each control portion that is accessible from the slot. In yet another embodiment, the buttons may be recessed to minimize accidental pressing. The recessed buttons protect the integrity of the programmed times and prevent dosages of the medicine from being consumed at the wrong time.

Those skilled in the art, in light of the present teachings, will recognize that the medicine dispensing record system may provide myriad benefits to the user, including, without limitation, reminding the user, in a visual and audible format, to take medicine at dosage times, alerting caregivers, in a visual and audible format, of dosage times, reduction of instances of under dose and overdose of medicine, providing means for effective control of required medicinal levels, positioning directly upon the cap of medicine containers regardless of shape or size, providing simple means to re-set dosage times to adhere to strict dosage schedules, prevention of illnesses and mortalities that result from accidental under and overdose, and being ideal for consumers on chronic medication regimens just beginning a medication regimen, and having memory deficiencies.

In one alternative embodiment, the cap record portion may include a processor for displaying, receiving, and transmitting dosage information between a medical facility and the cap record portion. In some embodiments, the cap record portion may also include a transmitter and a receiver for communicating dosage information between a medical facility and the cap record portion. In this manner, manually erasing the medicine information may not be necessary.

Figure 7:
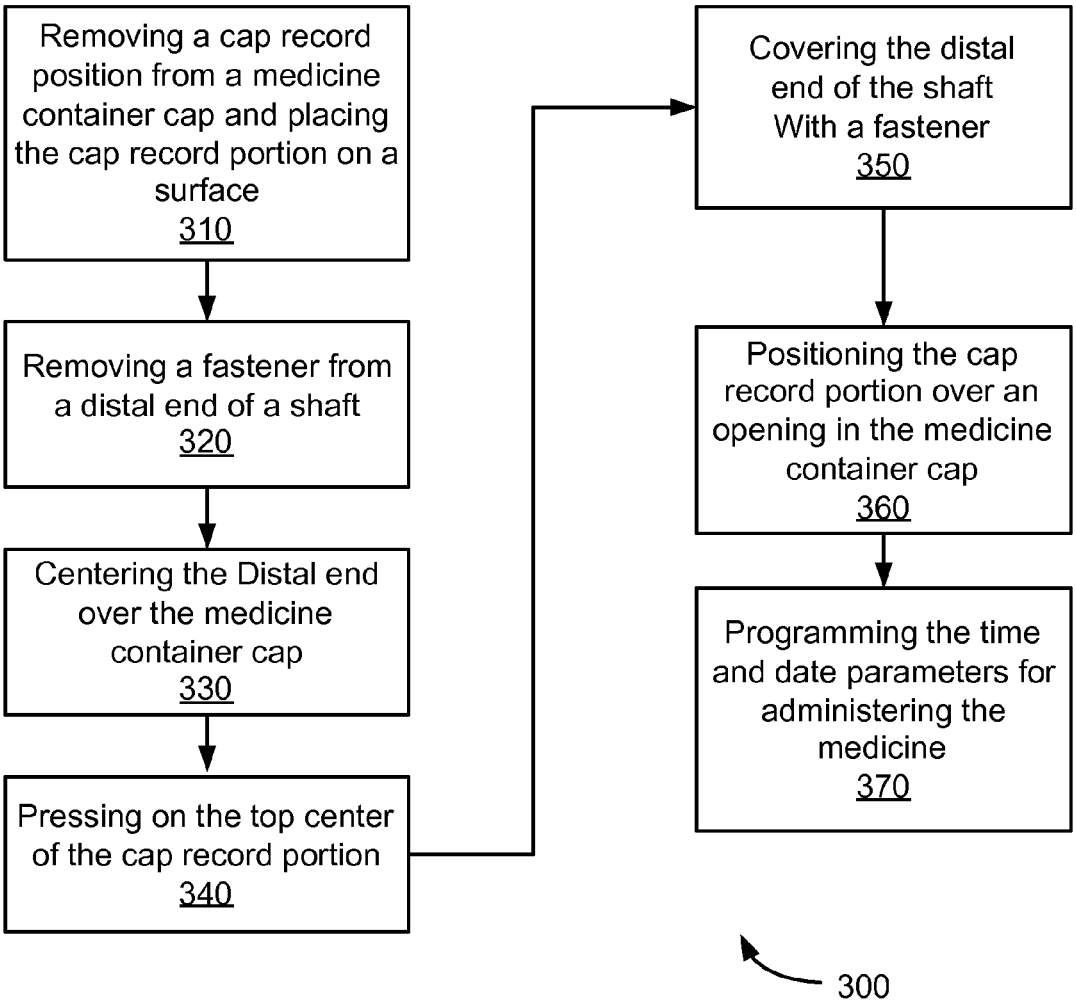
FIG. 7 illustrates a flowchart detailing an exemplary medicine dispensing record method, in accordance with an embodiment of the present invention.

FIG. 7 illustrates a flowchart detailing an exemplary method 300 of using the medicine dispensing record, in accordance with an embodiment of the present invention. In the present embodiments, the process may begin as an initial step 310 of removing the cap record portion from the medicine container and placing the cap record portion on a firm surface such as a counter top provides access to the medicine. The next step 320 involves removing the fastener from the distal end. In this manner, the cap record portion may be prepared to join with the medicine container cap. A next step 330 involves centering the distal end of the shaft in proximity to the medicine container cap. Those skilled in the art, in light of the present teachings, will recognize that the perimeter of the cap record portion should be aligned with the medicine container cap to provide an efficient and secure fit. The next step 340 includes pressing on the top center of the cap record portion until the shaft passes through the medicine container cap. The shaft may serve to secure the cap record portion to the medicine container cap by penetrating the medicine container cap with a sharp point on a distal end of the shaft. The next step 350 requires replacing the fastener onto the distal end of the shaft. The next step 360 includes positioning the cap record portion over the opening in the medicine container.

Those skilled in the art, in light of the present teachings, will recognize that the medicine container cap may be dimensioned and sized to attach to a variety of medicine containers, including, without limitation, a tubular pill bottle, a liquid medicine bottle, a rectangular pill box, a cylinder shaped bottle, and a pill dispenser. In some embodiments, the medicine container cap may be permanently glued or a part of the mold of the medicine container. However, in other embodiments, the medicine container cap may snap or slide onto the medicine container. The medicine container cap may secure to the medicine container through a perimeter lip.

In some embodiments, the medicine dispensing record system may be ready at this point to proceed with the next step 370 of programming the time and date parameters for administering the medicine. In some embodiments, the programming may include, without limitation, an hour button and a minute button may be depressed until the digital display screen displays the appropriate time. An OK button may be depressed to indicate approval. At the desired time, the audio portion may beep, and the illuminating portion may flash to indicate the time for taking the medicine dosage. In yet another example, a multiplicity of times, each representing different types of medicine may be programmed into the cap record portion, whereby a different audio signal emits to indicate a correlating medicine. In yet another example, without limitation, the Function button may be depressed one time to activate an LCD screen that flashes an initial time of 00:00 on the display portion. The hour and minute buttons may be manipulated to set the time, and then the OK button may be depressed. Next, the Function button may be depressed once to select a 24 hour dosage interval, and then the OK is depressed. In this manner, the user may be alerted for the need to administer the medicine in 24 hours. In another embodiment, the Function button may be depressed twice to select a 12 hour dosage interval and then the OK button. In another embodiment, the Function button may be depressed three times to select an 8 hour dosage interval, and then the OK button. In another embodiment, the Function button may be depressed four times to select a 6 hour interval, and then the OK button. In another embodiment, the Function button may be pressed five times to use the hour and minute buttons to program in a specific dosage interval, and then the OK button. In one embodiment, the alarm indicates the required time to administer the medicine. The alarm may be terminated, and the cap record portion may be prepared for the next activation by depressing a button on the sidewall of the cap record portion. However, if the user administers the medicine prior to the prescribed time, the OK button may be depressed to silence the alarm and cap record portion is prepared for the next activation. However, if the user administers the medicine after the prescribed time, but still requires the next dosage time to remain on its regular schedule, the button on the sidewall may be depressed. However, if the user administers the medicine later than the prescribed time, such as 15 minutes later, and the user requires rescheduling the next dosage time to be 15 minutes later than originally scheduled, the user may depress the Reset button. In any case, when the medicine container is empty, the user may remove the cap record portion from the medicine container cap and reuse it for a subsequent medicine container. Those skilled in the art, in light of the present teachings, will recognize that the cap record portion may be removed on the medicine container cap, and reused on a second medicine container cap. In this manner, different types and quantities of medicine may be administered with a single medicine dispensing record system, thereby reducing costs and increasing efficiency.

Those skilled in the art will readily recognize, in light of and in accordance with the teachings of the present invention, that any of the foregoing steps may be suitably replaced, reordered, removed and additional steps may be inserted depending upon the needs of the particular application. Moreover, the prescribed method steps of the foregoing embodiments may be implemented using any physical and/or hardware system that those skilled in the art will readily know is suitable in light of the foregoing teachings. For any method steps described in the present application that can be carried out on a computing machine, a typical computer system can, when appropriately configured or designed, serve as a computer system in which those aspects of the invention may be embodied. Thus, the present invention is not limited to any particular tangible means of implementation.

Figure 8:
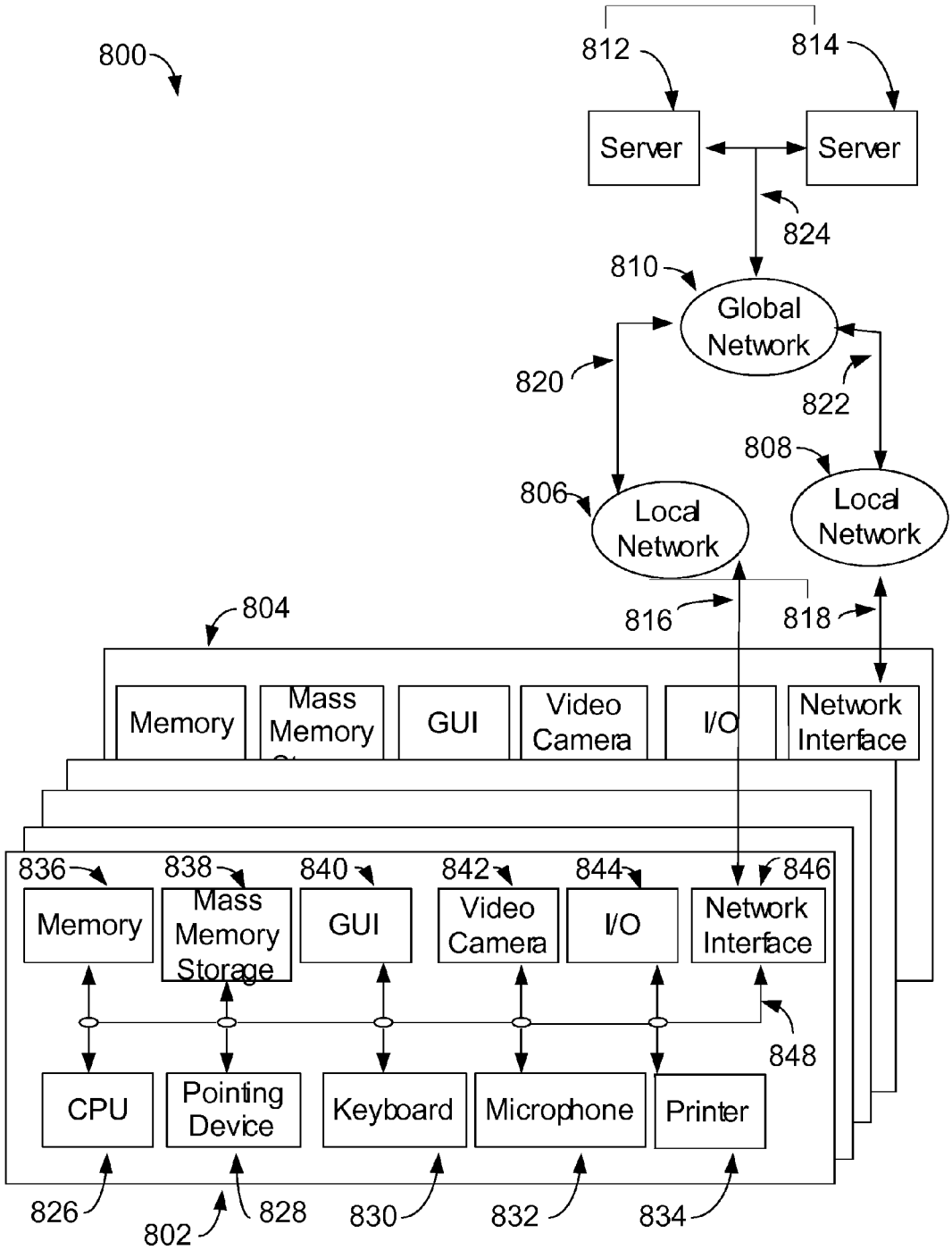
FIG. 8 illustrates a block diagram depicting an exemplary client/server system which may be used by an exemplary web-enabled/networked, in accordance with an embodiment of the present invention.

FIG. 8 illustrates a block diagram depicting an exemplary client/server system which may be used by an exemplary web-enabled/networked, in accordance with an embodiment of the present invention.

A communication system 800 includes a multiplicity of clients with a sampling of clients denoted as a client 802 and a client 804, a multiplicity of local networks with a sampling of networks denoted as a local network 806 and a local network 808, a global network 810 and a multiplicity of servers with a sampling of servers denoted as a server 812 and a server 814.

Client 802 may communicate bi-directionally with local network 806 via a communication channel 816. Client 804 may communicate bi-directionally with local network 808 via a communication channel 818. Local network 806 may communicate bi-directionally with global network 810 via a communication channel 820. Local network 808 may communicate bi-directionally with global network 810 via a communication channel 822. Global network 810 may communicate bi-directionally with server 812 and server 814 via a communication channel 824. Server 812 and server 814 may communicate bi-directionally with each other via communication channel 824. Furthermore, clients 802, 804, local networks 806, 808, global network 810 and servers 812, 814 may each communicate bi-directionally with each other.

In one embodiment, global network 810 may operate as the Internet. It will be understood by those skilled in the art that communication system 800 may take many different forms. Non-limiting examples of forms for communication system 800 include local area networks (LANs), wide area networks (WANs), wired telephone networks, wireless networks, or any other network supporting data communication between respective entities.

Clients 802 and 804 may take many different forms. Non-limiting examples of clients 802 and 804 include personal computers, personal digital assistants (PDAs), cellular phones and smartphones.

Client 802 includes a CPU 826, a pointing device 828, a keyboard 830, a microphone 832, a printer 834, a memory 836, a mass memory storage 838, a GUI 840, a video camera 842, an input/output interface 844 and a network interface 846.

CPU 826, pointing device 828, keyboard 830, microphone 832, printer 834, memory 836, mass memory storage 838, GUI 840, video camera 842, input/output interface 844 and network interface 846 may communicate in a unidirectional manner or a bi-directional manner with each other via a communication channel 848. Communication channel 848 may be configured as a single communication channel or a multiplicity of communication channels.

CPU 826 may be comprised of a single processor or multiple processors. CPU 826 may be of various types including micro-controllers (e.g., with embedded RAM/ROM) and microprocessors such as programmable devices (e.g., RISC or SISC based, or CPLDs and FPGAs) and devices not capable of being programmed such as gate array ASICs (Application Specific Integrated Circuits) or general purpose microprocessors.

As is well known in the art, memory 836 is used typically to transfer data and instructions to CPU 826 in a bi-directional manner. Memory 836, as discussed previously, may include any suitable computer-readable media, intended for data storage, such as those described above excluding any wired or wireless transmissions unless specifically noted. Mass memory storage 838 may also be coupled bi-directionally to CPU 826 and provides additional data storage capacity and may include any of the computer-readable media described above. Mass memory storage 838 may be used to store programs, data and the like and is typically a secondary storage medium such as a hard disk. It will be appreciated that the information retained within mass memory storage 838, may, in appropriate cases, be incorporated in standard fashion as part of memory 836 as virtual memory.

CPU 826 may be coupled to GUI 840. GUI 840 enables a user to view the operation of computer operating system and software. CPU 826 may be coupled to pointing device 828. Non-limiting examples of pointing device 828 include computer mouse, trackball and touchpad. Pointing device 828 enables a user with the capability to maneuver a computer cursor about the viewing area of GUI 840 and select areas or features in the viewing area of GUI 840. CPU 826 may be coupled to keyboard 830. Keyboard 830 enables a user with the capability to input alphanumeric textual information to CPU 826. CPU 826 may be coupled to microphone 832. Microphone 832 enables audio produced by a user to be recorded, processed and communicated by CPU 826. CPU 826 may be connected to printer 834. Printer 834 enables a user with the capability to print information to a sheet of paper. CPU 826 may be connected to video camera 842. Video camera 842 enables video produced or captured by user to be recorded, processed and communicated by CPU 826.

CPU 826 may also be coupled to input/output interface 844 that connects to one or more input/output devices such as such as CD-ROM, video monitors, track balls, mice, keyboards, microphones, touch-sensitive displays, transducer card readers, magnetic or paper tape readers, tablets, styluses, voice or handwriting recognizers, or other well-known input devices such as, of course, other computers.

Finally, CPU 826 optionally may be coupled to network interface 846 which enables communication with an external device such as a database or a computer or telecommunications or internet network using an external connection shown generally as communication channel 816, which may be implemented as a hardwired or wireless communications link using suitable conventional technologies. With such a connection, CPU 826 might receive information from the network, or might output information to a network in the course of performing the method steps described in the teachings of the present invention.

All the features or embodiment components disclosed in this specification, including any accompanying abstract and drawings, unless expressly stated otherwise, may be replaced by alternative features or components serving the same, equivalent or similar purpose as known by those skilled in the art to achieve the same, equivalent, suitable, or similar results by such alternative feature(s) or component(s) providing a similar function by virtue of their having known suitable properties for the intended purpose. Thus, unless expressly stated otherwise, each feature disclosed is one example only of a generic series of equivalent, or suitable, or similar features known or knowable to those skilled in the art without requiring undue experimentation.

Having fully described at least one embodiment of the present invention, other equivalent or alternative methods of implementing a dosage information device that fits onto a medicine container according to the present invention will be apparent to those skilled in the art. Various aspects of the invention have been described above by way of illustration, and the specific embodiments disclosed are not intended to limit the invention to the particular forms disclosed. The particular implementation of the dosage information device that fits onto a medicine container may vary depending upon the particular context or application. By way of example, and not limitation, the dosage information device that fits onto a medicine container described in the foregoing were principally directed to entering the next expected time for administration of medicine, and being alerted implementations; however, similar techniques may instead be applied to a device for watering plants or feeding pets on a regimented schedule that can be programmed and emit an alert at the prescribed time, which implementations of the present invention are contemplated as within the scope of the present invention. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Claim elements and steps herein may have been numbered and/or lettered solely as an aid in readability and understanding. Any such numbering and lettering in itself is not intended to and should not be taken to indicate the ordering of elements and/or steps in the claims.

What is claimed is:

1. A system comprising:

a cap record portion, said cap record portion being operable to record the administration of a medicine, said cap record portion comprising a record surface, said record surface comprising at least one display portion, said at least one display portion being operable to display dosage information about the administration of said medicine, said display surface further comprising at least one control portion, said at least one control portion being operable to control a timer, said cap record portion further comprising a mounting surface, said mounting surface being configured to engage a medicine container cap, said mounting surface comprising a shaft, said shaft being configured to extend from said mounting surface, said shaft being further configured to terminate at a distal end, said shaft being operable to pass through said medicine container cap, said medicine container cap being configured to inhibit a medicine from entering or exiting at least one opening in said medicine container; and a fastener, said fastener being configured to join with said distal end, said fastener being operable to press said medicine cap container against said cap record portion, wherein said fastener is operable to join with said distal end before said cap record portion engages said medicine container cap.

2. The system of claim 1, in which said medicine dispensing record system comprises a control portion cover, said control portion cover being configured to cover said at least one control portion.

3. The system of claim 2, wherein said control portion cover comprises a space portion, said space portion being configured to allow access to at least some of said at least one control portion.

4. The system of claim 3, in which said cap record portion comprises a processor portion, said processor portion being operable to process said timer.

5. The system of claim 4, in which said cap record portion comprises an illumination portion.

6. The system of claim 5, wherein said illumination portion is operable to alert about the administration of said medicine.

7. The system of claim 6, in which said cap record portion comprises an audio portion.

8. The system of claim 7, wherein said audio portion is operable to alert about the administration of said medicine.

9. The system of claim 8, in which said cap record portion comprises a power source.

10. The system of claim 9, wherein said power source is a battery.

11. The system of claim 10, wherein the distal end is sharp.

12. The system of claim 11, wherein said fastener is operable to join with said distal end after said cap record portion engages said medicine container cap.

13. The system of claim 12, in which said fastener comprises at least one projecting tab, said at least one projecting tab being operable to facilitate insertion and removal of said fastener to said distal end.

14. The system of claim 13, in which said at least one control portion comprises at least one button.

15. The system of claim 14, wherein said at least one button is operable to manipulate said timer.

16. The system of claim 15, wherein said at least one button is operable to reset said timer.

17. The system of claim 16, in which said record surface comprises a marking surface for recording information about the administration of said medicine.

18. A method comprising the steps of:

removing a cap record portion from a medicine container and placing said cap record portion on a firm surface;

removing a fastener from a distal end of a shaft;

centering said distal end over said medicine container cap, wherein said fastener is operable to join with said distal end before said cap record portion engages said medicine container cap;

pressing on a top center area of said cap record portion until said shaft passes through said medicine container cap;

covering said distal end with a fastener;

positioning said cap record portion over an opening in said medicine container; and programming a time and date parameter for administering a medicine.

19. A medicine dispensing record system consisting of:

a cap record portion, said cap record portion being operable to record the administration of a medicine, said cap record portion comprising a record surface, said record surface comprising at least one display portion, said at least one display portion being operable to display dosage information about the administration of said medicine, said display surface further comprising at least one control portion, said at least one control portion comprising at least one button, said at least one control portion being operable to control a timer, said cap record portion further comprising a mounting surface, said mounting surface being configured to engage a medicine container cap, said mounting surface comprising a shaft, said shaft being configured to extend from said mounting surface, said shaft being further configured to terminate at a distal end, said shaft being operable to pass through said medicine container cap, said medicine container cap being configured to inhibit a medicine from entering or exiting at least one opening in said medicine container, said cap record portion further comprising a control portion cover, said control portion cover being configured to cover said at least one control portion, said cap record portion further comprising a processor portion, said processor portion being operable to process said timer, said cap record portion further comprising an illumination portion, said illumination portion being operable to alert about the administration of said medicine, said cap record portion further comprising an audio portion, said audio portion being operable to alert about the administration of said medicine, said cap record portion further comprising a power source; and a fastener, said fastener being configured to join with said distal end, said fastener being operable to secure said cap record portion to said medicine cap container, said fastener comprising at least one projecting tab, said at least one projecting tab being operable to facilitate insertion and removal of said fastener to said distal end, wherein said fastener is operable to join with said distal end before said cap record portion engages said medicine container cap.

* * * * *